US006394336B1

(12) United States Patent
Beneroff et al.

(10) Patent No.: US 6,394,336 B1
(45) Date of Patent: May 28, 2002

(54) ADJUSTABLE CONTAINER AND A METHOD FOR FORMING AN ADJUSTABLE CONTAINER

(75) Inventors: Richard Beneroff, Harding Township; Eric Kim, Secaucus; Jeffrey A. Smith, Clark, all of NJ (US)

(73) Assignee: Motion Design, Inc., Linden, NJ (US)

( * ) Notice: Subject to any disclaimer, the term of this patent is extended or adjusted under 35 U.S.C. 154(b) by 0 days.

(21) Appl. No.: 09/516,710

(22) Filed: Mar. 1, 2000

(51) Int. Cl.[7] ..... B65D 5/355

(52) U.S. Cl. ..... 229/101; 229/103.3; 229/137; 229/138; 229/155

(58) Field of Search ..... 229/101, 103.3, 229/132, 136, 137, 138, 155

(56) References Cited

U.S. PATENT DOCUMENTS

| | | | | |
|---|---|---|---|---|
| 661,662 | A | | 11/1900 | White |
| 680,186 | A | | 8/1901 | Wormer |
| 715,026 | A | | 12/1902 | Crawford |
| 756,311 | A | | 4/1904 | Adams |
| 975,792 | A | | 11/1910 | Pittman |
| 1,054,530 | A | | 2/1913 | Goodyear |
| 1,156,250 | A | | 10/1915 | Scott |
| 1,561,138 | A | | 11/1925 | Charters |
| 1,808,833 | A | * | 6/1931 | Brack ..... 229/101 |
| 1,985,111 | A | | 12/1934 | Shofer et al. |
| 2,293,187 | A | | 8/1942 | Becker |
| 2,333,416 | A | * | 11/1943 | Ducey ..... 229/101 |
| 2,562,261 | A | * | 7/1951 | Collins ..... 229/103.3 |
| 2,593,773 | A | | 4/1952 | Levkoff |
| 2,761,609 | A | | 9/1956 | Arkin |
| 2,791,367 | A | | 5/1957 | Mefford |
| 3,039,670 | A | | 6/1962 | Hardon |
| 3,074,617 | A | | 1/1963 | Kindseth et al. |
| 3,144,979 | A | | 8/1964 | Young |
| 3,180,555 | A | | 4/1965 | Barrett |
| 3,198,420 | A | | 8/1965 | Hiersteiner |
| 3,199,762 | A | | 8/1965 | Coons |
| 3,248,039 | A | | 4/1966 | Locke |
| 3,254,825 | A | | 6/1966 | Nolen |
| 3,280,871 | A | | 10/1966 | Taylor ..... 150/52 |
| 3,300,166 | A | | 1/1967 | Wojciechowski ..... 248/174 |
| 3,313,467 | A | * | 4/1967 | Anderskow et al. ..... 229/101 |
| 3,319,684 | A | | 5/1967 | Calhoun ..... 150/8 |
| 3,346,399 | A | * | 10/1967 | Watson et al. ..... 229/101 |
| 3,367,380 | A | | 2/1968 | Dickey ..... 150/1 |
| 3,376,994 | A | | 4/1968 | Flinn, Jr. |
| 3,411,691 | A | | 11/1968 | Whitaker et al. |
| 3,455,499 | A | | 7/1969 | Anderson |
| 3,565,325 | A | | 2/1971 | Pugsley |
| 3,638,852 | A | | 2/1972 | Solanka |
| 3,658,234 | A | | 4/1972 | Deckys |
| 4,238,068 | A | * | 12/1980 | Ellerbe et al. ..... 229/101 |
| 4,265,393 | A | * | 5/1981 | Orchard ..... 229/103.3 |
| 4,272,009 | A | * | 6/1981 | Bamburg et al. ..... 229/101 |
| 4,274,577 | A | | 6/1981 | Walsh, Jr. |
| 4,402,452 | A | | 9/1983 | Kupersmit |
| 4,589,552 | A | | 5/1986 | Chevalier |
| 4,596,355 | A | | 6/1986 | Kupersmit |
| 4,657,176 | A | | 4/1987 | Matsubara |
| 4,938,413 | A | | 7/1990 | Wolfe ..... 229/101 |
| 5,197,260 | A | | 3/1993 | Chevalier et al. |
| 5,318,219 | A | | 6/1994 | Smith ..... 229/117.05 |
| 5,421,509 | A | | 6/1995 | Thuin et al. ..... 229/117.07 |
| 5,474,230 | A | | 12/1995 | Yotukura ..... 229/117.04 |
| 5,725,114 | A | | 3/1998 | Stone et al. ..... 229/101 |
| 5,762,261 | A | | 6/1998 | Okabe et al. ..... 209/117.08 |
| 5,762,262 | A | | 6/1998 | Martin ..... 229/120.21 |

FOREIGN PATENT DOCUMENTS

| | | | | |
|---|---|---|---|---|
| GB | 2035266 | A | * | 6/1980 ..... 229/101 |

* cited by examiner

*Primary Examiner*—Gary E. Elkins
(74) *Attorney, Agent, or Firm*—Kenyon & Kenyon

(57) ABSTRACT

An adjustable container includes top, bottom and four side panels. Each of the four side panels is scored along at least one longitudinal score line extending substantially parallel to the top and bottom panels. Two of the opposing side panels are scored along oblique score lines, each oblique score line extending from one corner of the side panel toward and intersecting the longitudinal score line. The height of the container is adjustable by folding the side panels inwardly toward the interior of the container along the longitudinal and oblique score lines.

22 Claims, 12 Drawing Sheets

ADJUSTABLE CONTAINER AND A METHOD FOR FORMING AN ADJUSTABLE CONTAINER

BACKGROUND OF THE INVENTION

1. Field of the Invention

The present invention relates to containers. More particularly, the present invention relates to adjustable containers and methods of forming adjustable containers.

2. Brief Description of the Related Art

The literature is replete with descriptions of collapsible containers.

U.S. Pat. No. 2,791,367 to Mefford describes a collapsible container having an upper, non-collapsible portion and a lower, collapsible portion. The collapsible portion is formed by score lines parallel to the top and bottom of the container and diagonal score lines extending from the corners of two opposing sides to the score line parallel to the top and bottom of the container. The collapsible portion is collapsed by folding the same along the score lines.

U.S. Pat. No. 3,144,979 to Young describes an expansible corrugated paperboard carton. The carton includes side panels, each of which is scored along a centrally located score line that extends perpendicularly to the top and bottom of the carton. The carton is collapsible by folding the side panels inwardly along the score lines.

U.S. Pat. No. 3,198,420 to Hiersteiner describes an expandable container having solid front and back panels connected by expandable side walls.

U.S. Pat. No. 3,254,825 to Nolen describes a container having an accordion fold closure. The container includes side walls and closure panels extending from each of two opposing side edges of the side walls. Each of the closure panels includes a fold line extending parallel to the side edges of the side walls, and two opposing closure panels include diagonal fold lines extending from each corner thereof to the aforementioned fold line. The closure panels are collapsed by folding the same along the parallel and diagonal fold lines.

U.S. Pat. No. 3,280,871 to Taylor describes an expansible case having a rigid bottom wall and four side walls extending from the bottom wall. Each of the side walls is bent upon itself to provide a plurality of superimposed flexible folds, thereby resulting in an accordion-pleated bellows.

U.S. Pat. No. 3,455,499 to Anderson describes an adjustable container having a bottom panel, a pair of opposing end panels and a pair of overlapping top flaps. The angular disposition of the end panels with respect to the top and bottom panels defines the height of the container. A pair of opposing side panels, each having a plurality of fold lines, is provided, and the side panels are folded along one of the fold lines and secured to the top panel to lock the container at the desired height.

U.S. Pat. No. 4,589,552 to Chevalier describes a package, which includes a strip of corrugated cardboard and transverse flaps. The strip is wrapped around objects placed on its inside surface and around the transverse flaps.

U.S. Pat. No. 4,938,413 to Wolfe describes a collapsible box having a rectangular bottom and four side walls. An accordion fold extends horizontally across the four sides of the box.

U.S. Pat. No. 5,197,260 to Chevalier et al. describes a method and machine for packaging articles. The package includes a base and side tabs. The tabs are folded over the article placed on the base. A first flap is then folded over the tabs and the article, and a second flap is then folded over the first flap.

U.S. Pat. No. 5,725,144 to Stone et al. describes a collapsible paperboard carton having four side walls. Each of the side walls includes a carton-collapsing accordion panel.

U.S. Pat. No. 5,762,262 to Martin describes a collapsible container having a non-collapsible top section, a non-collapsible base section and a collapsible central section disposed between the top and base sections. The central section includes four walls, each having a fold line extending diagonally between opposite corners. The container is collapsed by twisting the base section relative to the top section to thereby fold the walls along the fold lines.

Each of the aforementioned containers has certain disadvantages. Firstly, the containers generally provide for only two usable states: the fully collapsed state and the fully erected or assembled state. The fully collapsed state is for storing and/or transporting the empty containers. In the fully assembled state, an internal volume is provided for storing the contents. However, the contents may be significantly smaller than the container in one or more dimensions. Packing material must then be provided to safely and effectively package the contents.

Those containers described above that are adjustable over a range between the fully collapsed state and the fully assembled state are adjustable over a very narrow range or are adjustable in only one dimension or lack stability in one or more dimensions.

It is an object of the present invention to provide a container that can accommodate a variety of contents in a space-efficient manner. It is a further object of the present invention to provide a container that is widely adjustable between a fully collapsed state and a fully assembled state.

SUMMARY OF THE INVENTION

The above and other beneficial objects of the present invention are most effectively attained by providing an adjustable container as described and claimed herein. In one embodiment, the adjustable container has a rectangular top panel, a rectangular bottom panel and four side panels extending between the top and bottom panels. The side panels are scored so that the side panels may be at least partially collapsed to adapt the container to the dimensions of the contents thereof in a space-efficient manner. This construction allows the external volume of the container to adjust depending on the contents.

DETAILED DESCRIPTION OF THE INVENTION

Figure 1:
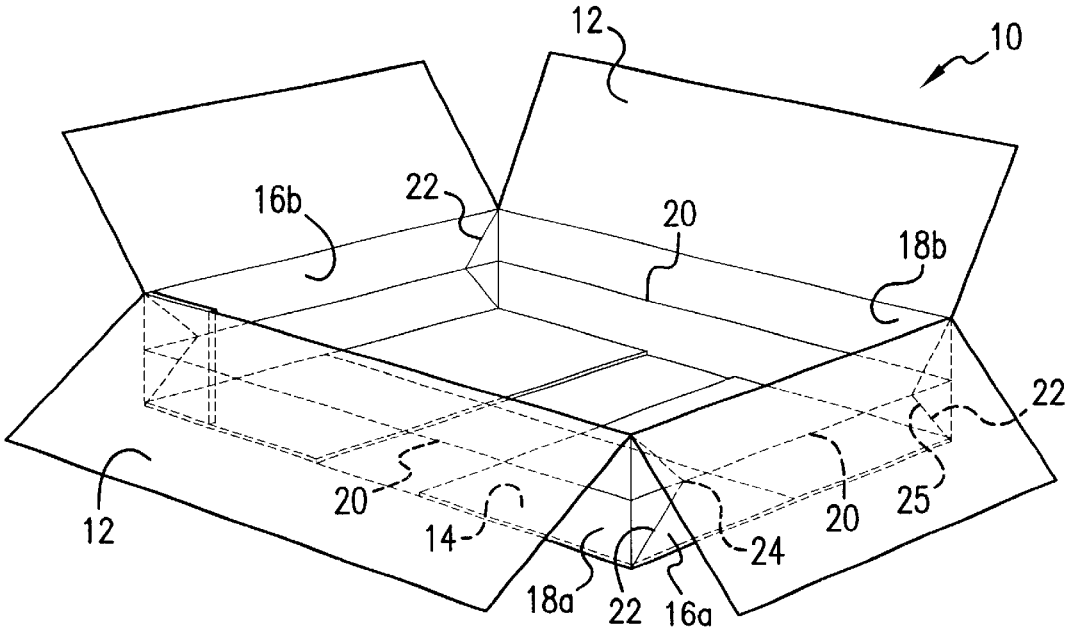
FIG. 1 is a front perspective view of an adjustable container of the present invention.

Those skilled in the art will gain an appreciation of the present invention when viewed in conjunction with the accompanying drawings of FIGS. 1–21, inclusive. The individual reference characters designate the same or similar elements throughout the several drawings.

Referring to FIG. 1, there is seen a front perspective view of an adjustable container 10. Container 10 includes a rectangular top panel 12, a rectangular bottom panel 14, two opposing first side panels 16*a*, 16*b* and two opposing second side panels 18*a*, 18*b*. Adjacent panels are hingedly secured to each other to define a unitary structure, either by virtue of the panels being formed by folding or by attaching separately formed panels by, for example, adhesives or adhesive tape. Each of the top panel 12, the bottom panel 14, the first side panels 16*a*, 16*b* and the second side panels 18*a*, 18*b* are preferably composed of a corrugated material, such as corrugated cardboard. However, it should be appreciated that the several panels 10, 12, 14, 16*a*, 16*b*, 18*a*, 18*b* may be composed of any sheet-like material.

Each of the first side panels 16*a*, 16*b* and second side panels 18*a*, 18*b* are scored along a score line 20, which is referred to hereinafter as a longitudinal score line. It will be appreciated that the term "scoring" as used herein includes partially cutting through the thickness of the sheet material, perforating the sheet material, forming a crease or other weakening in the sheet material or otherwise hinging the material. Longitudinal score line 20 extends along each of the first side panels 16*a*, 16*b* and the second side panels 18*a*, 18*b* substantially parallel to the top panel 12 and to the bottom panel 14. Longitudinal score line 20 is located along the height of the first side panels 16*a*, 16*b* and the second side panels 18*a*, 18*b*.

Each of the first side panels 16*a*, 16*b* is further scored along four oblique score lines 22. Each oblique score line 22 extends from a respective corner of first side panel 16*a*, 16*b* obliquely toward longitudinal score line 20 and intersects longitudinal score line 20 at intersection point 24 or 25. At least two of the oblique score lines 22 intersect longitudinal score line 20 at each common intersection point 24 or 25.

As illustrated in FIG. 1, when first side panels 16*a*, 16*b* and second side panels 18*a*, 18*b* are made planar, that is, when first side panels 16*a*, 16*b* and second side panels 18*a*, 18*b* are not folded along longitudinal score line 20 and oblique score lines 22, the first side panels 16*a*, 16*b*, second side panels 18*a*, 18*b*, along with top panel 12 and bottom panel 14 define a rectangular parallelepiped.

Figure 2:
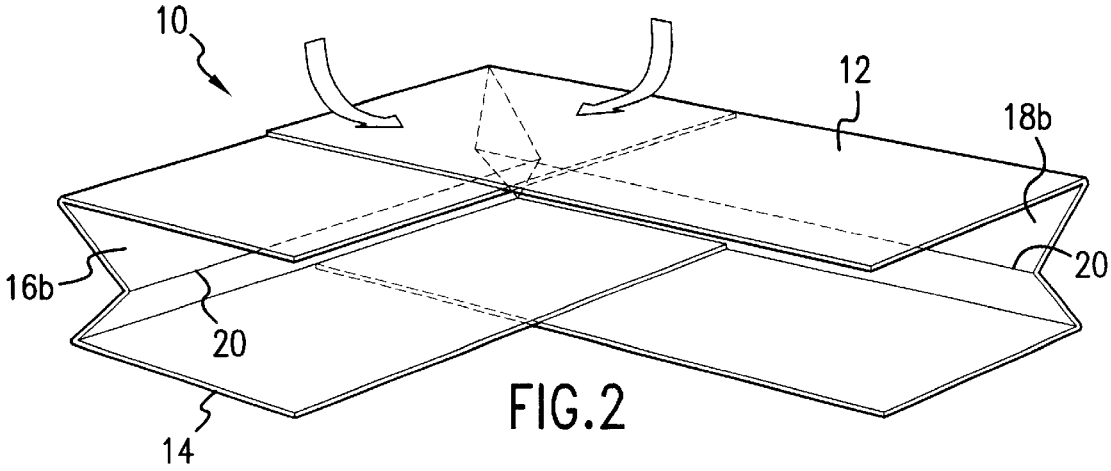
FIG. 2 is a front perspective view of the adjustable container illustrated in FIG. 1 in a partially collapsed state.

Referring now to FIG. 2, there is seen a front perspective view of the adjustable container 10 illustrated in FIG. 1 in a partially collapsed state. Container 10 is adjusted or collapsed by applying a force or pressure on one or more of the panels 12, 14, 16*a*, 16*b*, 18*a*, 18*b*. More particularly, the application of a force or pressure on one or more of the panels 12, 14, 16*a*, 16*b*, 18*a*, 18*b* in an orthogonal direction causes the first side panels 16*a*, 16*b* and second side panels 18*a*, 18*b* to fold inwardly with respect to the interior of container 10 along longitudinal score line 20 and oblique score lines 22. This pressure or force may be applied in one or more of the orthogonal directions by machine. Preferably, this pressure or force is machine-applied to the first side panels 16*a*, 16*b* and second side panels 18*a*, 18*b* while simultaneously applying pressure or force on the top panel 12 and bottom panel 14.

Figure 3:
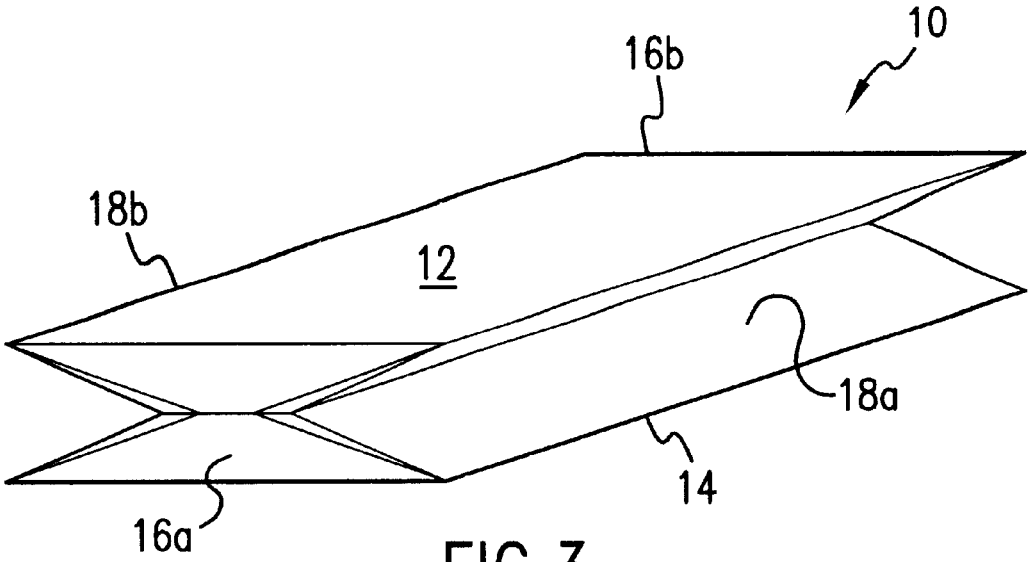
FIG. 3 is a front perspective view of the adjustable container illustrated in FIGS. 1 and 2 in a fully collapsed state.

Referring now to FIG. 3, there is seen a front elevational view of the adjustable container 10 shown in FIGS. 1 and 2 but in a fully collapsed state. In the fully collapsed state, the container 10 assumes a substantially flattened configuration relative to the container 10 in its assembled or erected state.

Figure 6:
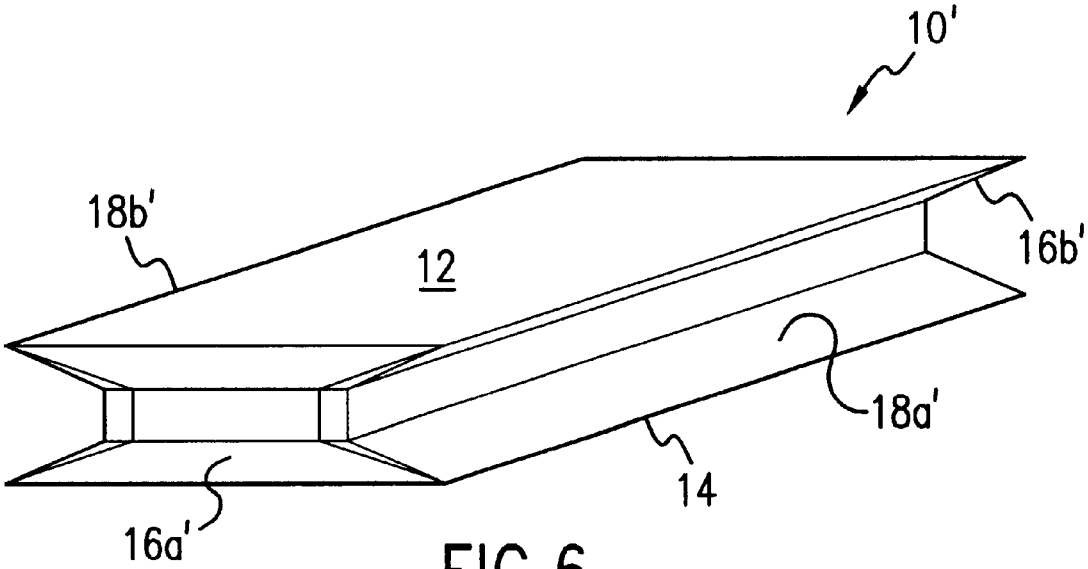
FIG. 6 is a front perspective view of the adjustable container illustrated FIGS. 4 and 5 in a fully collapsed state.
Figure 4:
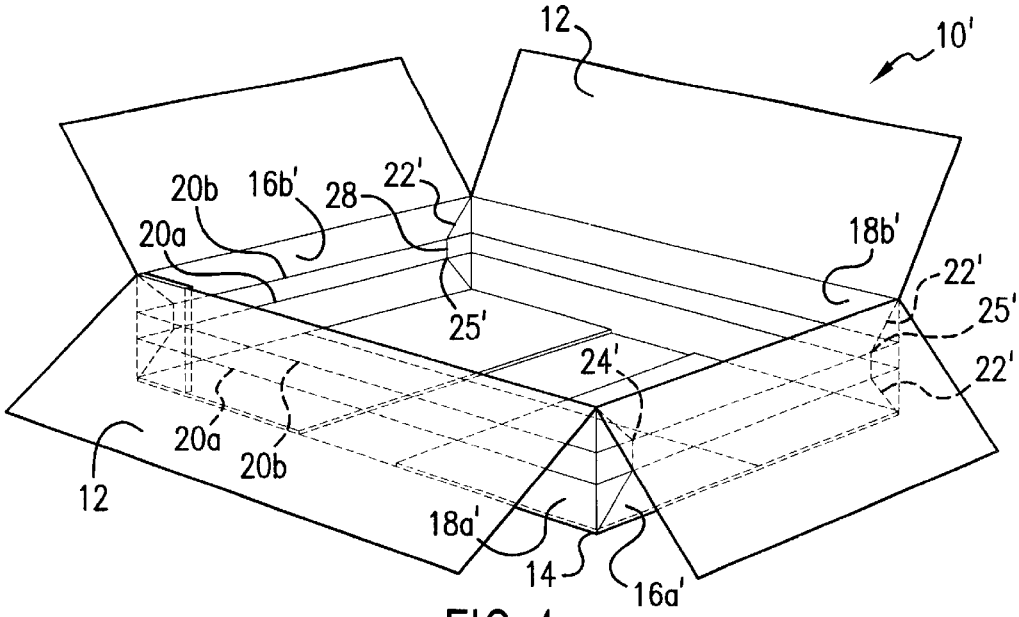
FIG. 4 is a front perspective view of a second embodiment of the adjustable container of the present invention.
Figure 5:
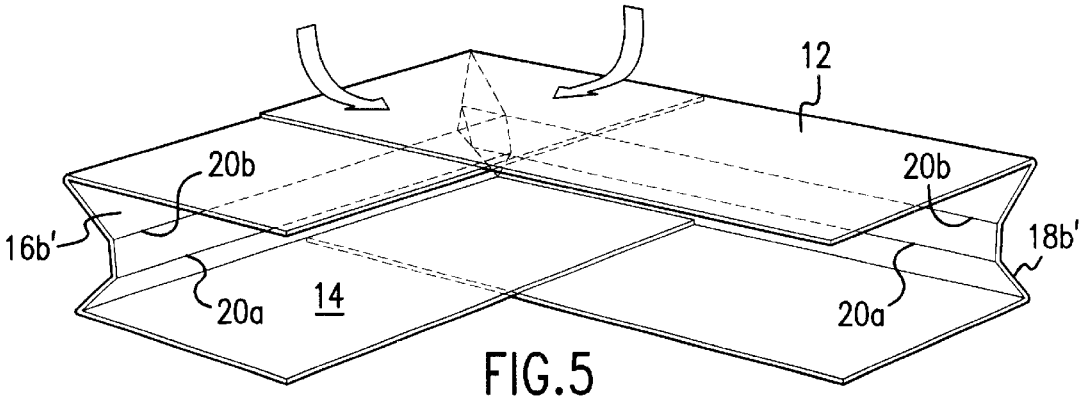
FIG. 5 is a front perspective view of the adjustable container illustrated in FIG. 4 in a partially collapsed state.

FIGS. 4–6 illustrate a second embodiment container 10', wherein like elements are indicated by an accompanying prime. Container 10' includes first side panels 16*a*', 16*b*' and second side panels 18*a*', 18*b*'. Each of first side panels 16*a*', 16*b*' and second side panels 18*a*', 18*b*' is scored along two longitudinal score lines 20*a*, 20*b*, each extending substantially parallel to top panel 12 and to bottom panel 14. In this second embodiment container 10', oblique score lines 22' intersect one of the longitudinal score lines 20*a*, 20*b* at a respective intersection point 24'. Each of the first side panels 16*a*', 16*b*' is scored along third score lines 28, which extend perpendicularly to the longitudinal score lines 20*a*, 20*b* between two intersection points 24'.

Similar to FIG. 2, FIG. 5 illustrates container 10' in a partially collapsed state. Similar to FIG. 3, FIG. 6 illustrates container 10' in its fully collapsed state. In its fully collapsed state, container 10' has a height substantially equal to the distance between the longitudinal score lines 20*a*, 20*b*.

Figure 7:
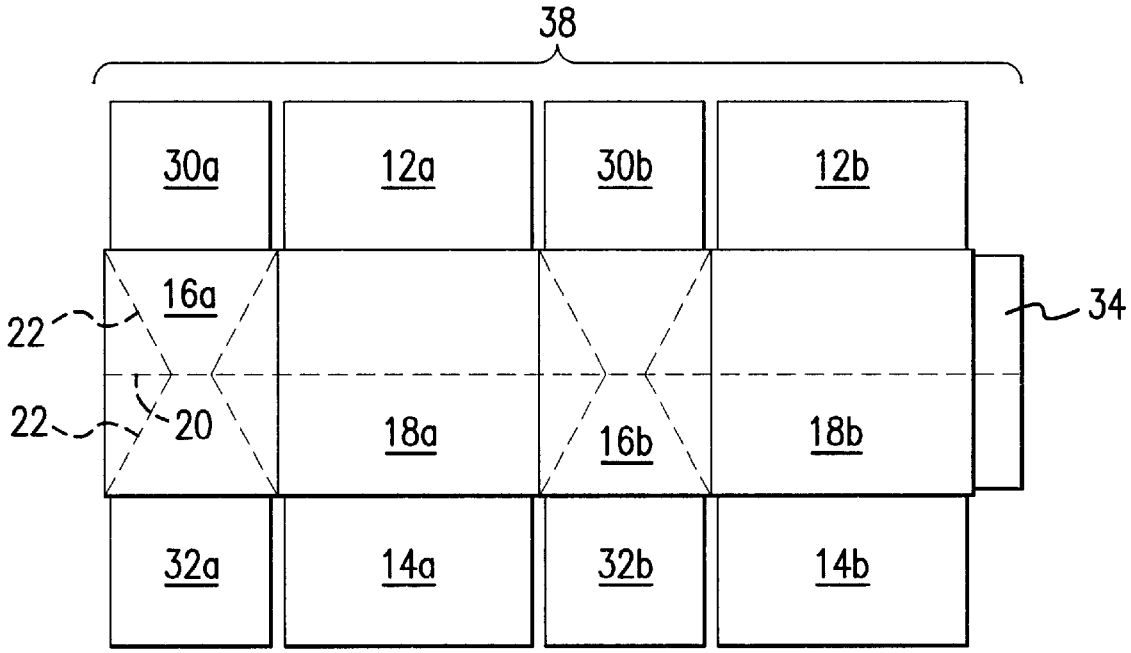
FIG. 7 is a top plan view of a sheet for forming the adjustable container illustrated in FIGS. 1–3.

Referring now to FIG. 7, there is seen a top plan view of a first embodiment sheet 38 for forming container 10. Sheet 38 includes the first side panels 16*a*, 16*b* and the second side panels 18*a*, 18*b*. First side panel 16*a* is arranged adjacent to second side panel 18*a*, which is, in turn, arranged adjacent to first side panel 16*b*, which is, in turn, arranged adjacent to second side panel 18*b*. Flap 34 extends from one side edge of second side panel 18*b*, and, when container 10 is formed from sheet 38, flap 34 is secured to the adjacent side edge of first side panel 16*a* by, for example, an adhesive or adhesive tape. Accordingly, container 10 formed from sheet 38 has a seam extending along adjacent first side panel 16*a* and second side panel 18*b* from one corner of top panel 12 to the corresponding corner of bottom panel 14. Top panel flaps 12*a*, 12*b* respectively extend from the top edges of second side panels 18*a*, 18*b*. When container 10 is formed from sheet 38, top panel flaps 12*a*, 12*b* are folded inwardly, the top edges of top panel flaps 12*a*, 12*b* abutting, to define top panel 12. Similarly, bottom panel flaps 14*a*, 14*b*, which respectively extend from the bottom edges of second side panels 18*a*, 18*b*, define bottom panel 14. Additional top panel flaps 30*a*, 30*b* and bottom panel flaps 32*a*, 32*b* respectively extend from the top edges and bottom edges of first side panels 16*a*, 16*b*. The abutting top panel flaps 12*a*, 12*b* and the abutting bottom panel flaps 14*a*, 14*b* may be secured by use of a tape or strap arranged parallel to the abutting edges or perpendicular thereto.

Figure 8:
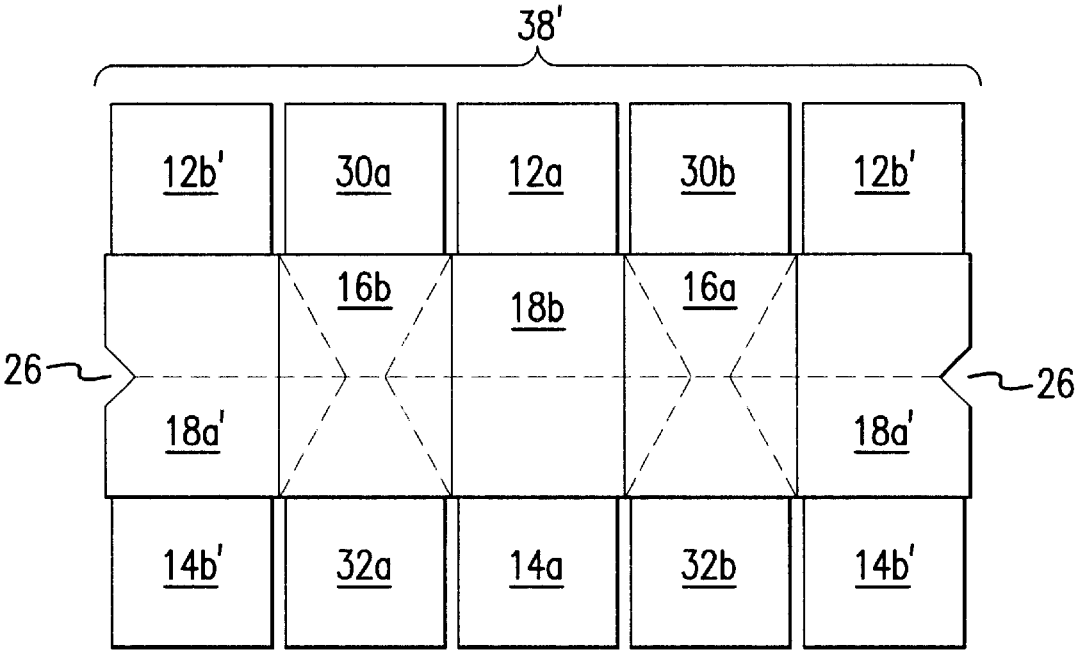
FIG. 8 is a top plan view of a second embodiment sheet for forming the adjustable container illustrated in FIGS. 1–3.
Figure 9:
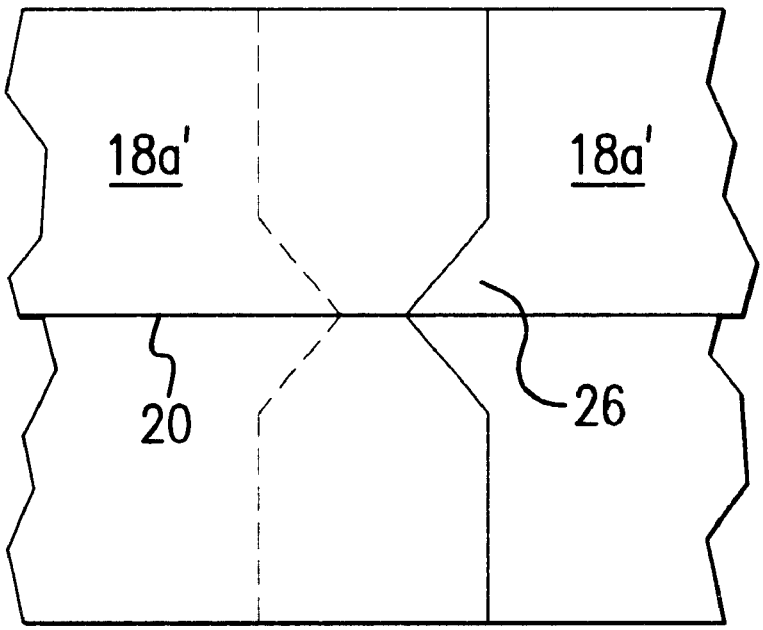
FIG. 9 is a front elevational view of a portion of a side panel of the adjustable container formed by the second embodiment forming sheet illustrated in FIG. 8.

Referring now to FIG. 8, there is seen a top plan view of a second embodiment sheet 38' for forming container 10. Sheet 38' is substantially identical to sheet 38 illustrated in FIG. 7 except that sheet 38' includes two second side panel flaps 18*a*' and lacks flap 34. To form container 10 with sheet 38', the two second side panel flaps 18*a*' are overlapped, and the overlapping area thereof is secured by, for example, an adhesive. The overlapping second side panel flaps 18*a*' thereby define second side panel 18*a*. The top flap 12*b* is formed by similarly overlapping flaps 12*b*', and bottom flap 14*b* is formed by overlapping flaps 14*b*'. Each of the second side panel flaps 18*a*' includes a notch 26, which extends obliquely from the longitudinal score 20 to permit the second side panel 18*a* to collapse or fold inwardly without interference. FIG. 9 illustrates the notches 26 when the container 10 is assembled from sheet 38'.

Figure 10:
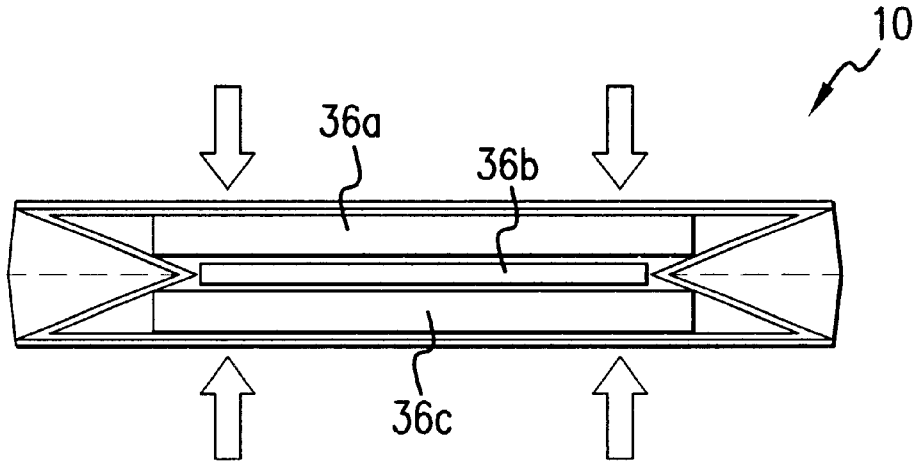
FIG. 10 is a front elevational view of the adjustable container illustrated in FIGS. 1–3 filled with contents.

Referring now to FIG. 10, there is seen a front elevation view of container 10, which is partially filled with contents 36*a*, 36*b*, 36*c*, such as, for example, books or compact discs. In the examples shown, the width of each of content 36*a* and 36*c* is greater than that of content 36*b*. When packing the contents 36*a*, 36*b*, 36*c* in container 10, content 36*b* is arranged between the wider contents 36*a*, 36*c*. The container 10 is then partially collapsed so that the container 10 attains a height of approximately the combined height of contents 36*a*, 36*b*, 36*c*. Of course, the height of container 10 includes the thickness of the sheet-like material thereof, but such thickness is substantially less than the combined height of the contents 36*a*, 36*b*, 36*c*.

Figure 11:
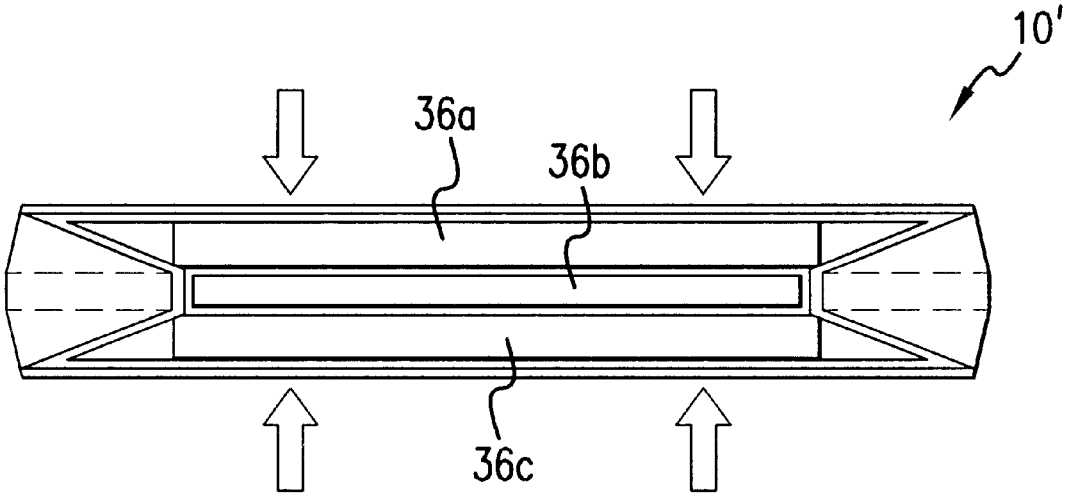
FIG. 11 is a front elevational view of the second embodiment adjustable container illustrated in FIGS. 4–6 filled with contents.
Figure 12:
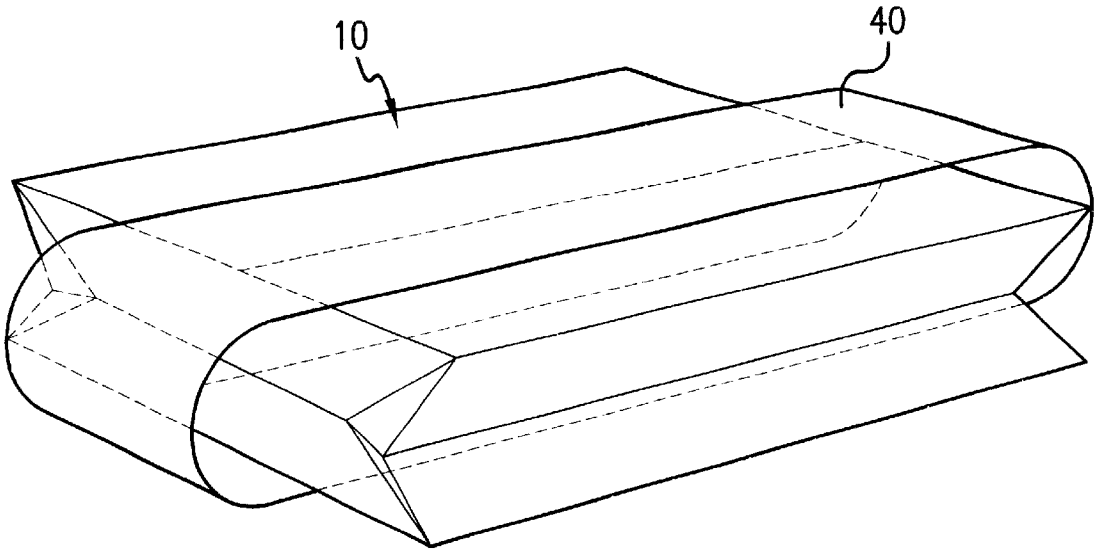
FIG. 12 is a front elevational view of the adjustable container illustrated in FIGS. 1–3 that is taped or strapped in a partially collapsed state.
Figure 13:
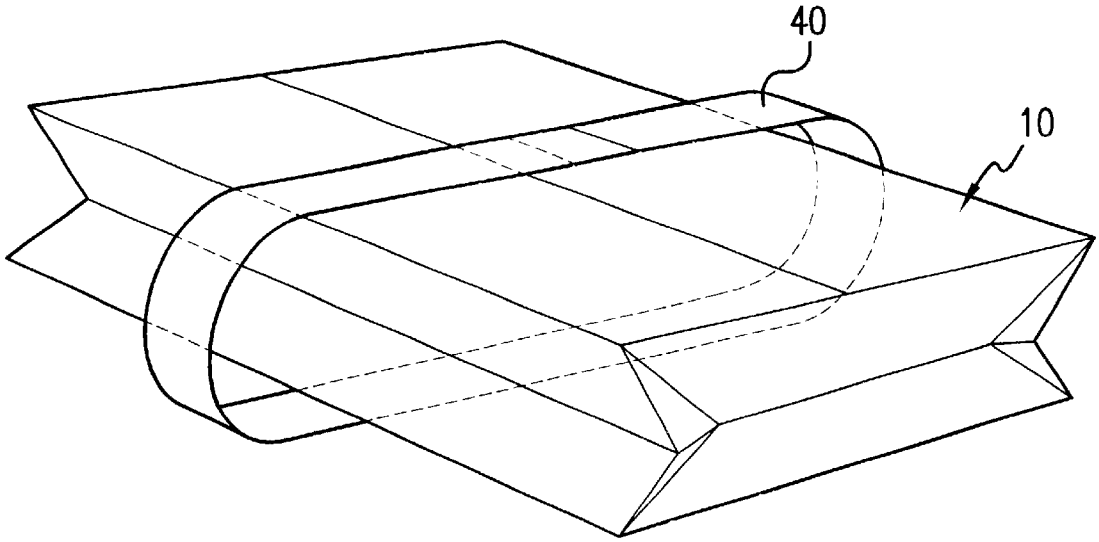
FIG. 13 is a front elevational view of the adjustable container illustrated in FIGS. 1–3 that is taped or strapped in a partially collapsed state.

FIG. 11 illustrates second embodiment container 10' partially filled with contents 36*a*, 36*b*, 36*c*. As shown in FIGS. 10 and 11, the container 10, 10' can be adapted to the contents thereof, and the container 10, 10' can accommodate contents that have various dimensions. The partially collapsed container may be maintained in its partially collapsed position by use of tape or a strap 40, which may be applied by the machine described hereinabove, placed around the container and urging the top panel 12 and the bottom panel 14 toward each other and toward the contents 36*a*, 36*b*, 36*c*. FIGS. 12 and 13 illustrate two possible arrangements of tape or strap 40 for maintaining the container 10 in a partially collapsed state.

Figure 14:
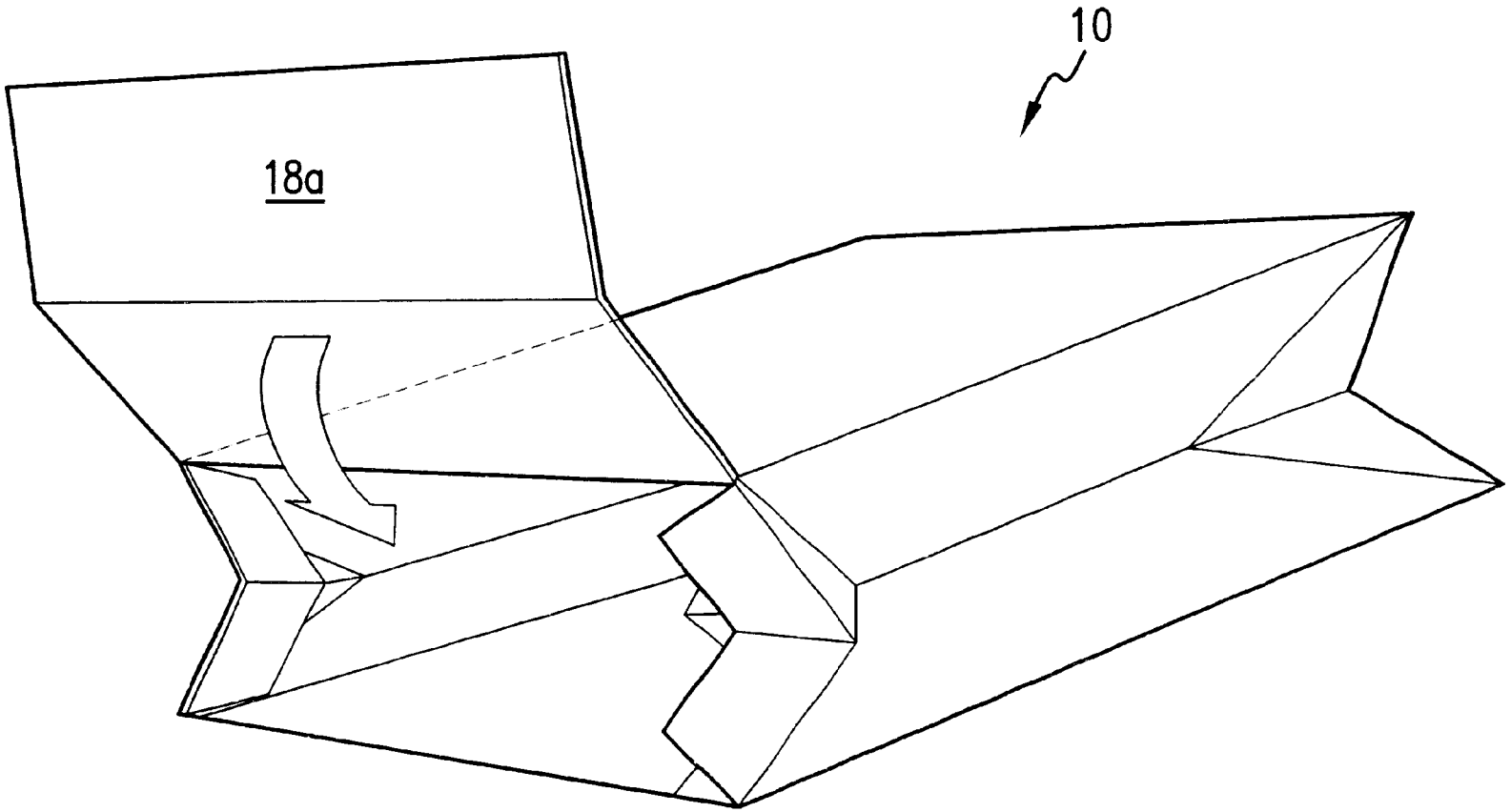
FIG. 14 is a front elevational view of another embodiment adjustable container according to the present invention.
Figure 15:
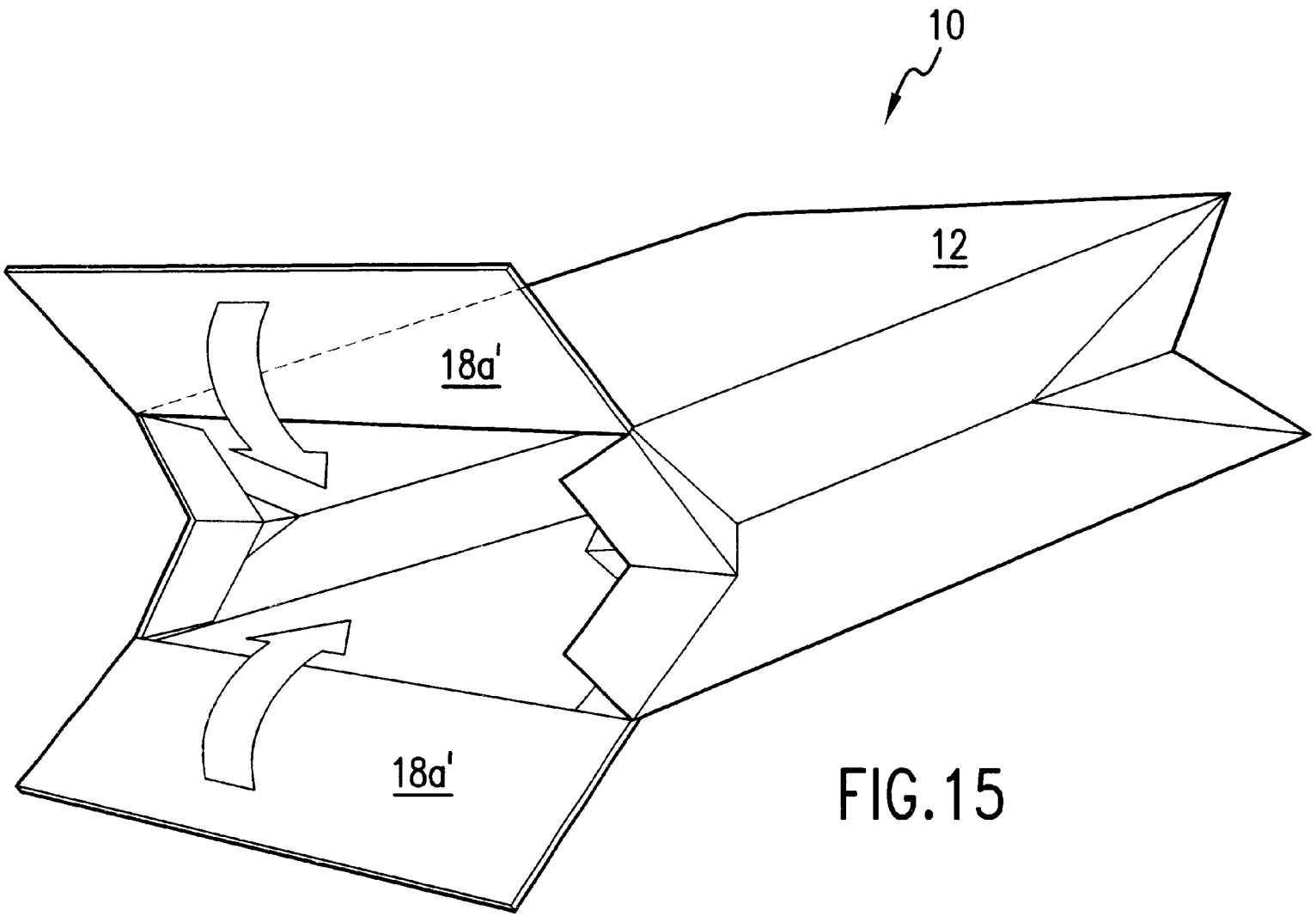
FIG. 15 is a front elevational view of yet another embodiment adjustable container according to the present invention.

FIGS. 14 and 15 illustrate alternative embodiments of the container 10, wherein the second side panel 18*a* provides for side-loading of the container 10. In FIG. 14, second side panel 18*a* is defined by a single flap, which may be secured to the top panel 12 on its top edge by, for example, an adhesive or adhesive tape, to seal the container 10. In FIG. 15, second side panel 18*a* is defined by a pair of opposing and abutting flaps 18*a*'. The abutting edges of flaps 18*a*' may be secured to each other by, for example, adhesive tape, to thereby seal the container. Alternatively, the sideloading arrangements of the second side panel 18*a* may be applied to the first side panel 16*a*.

Figure 16:
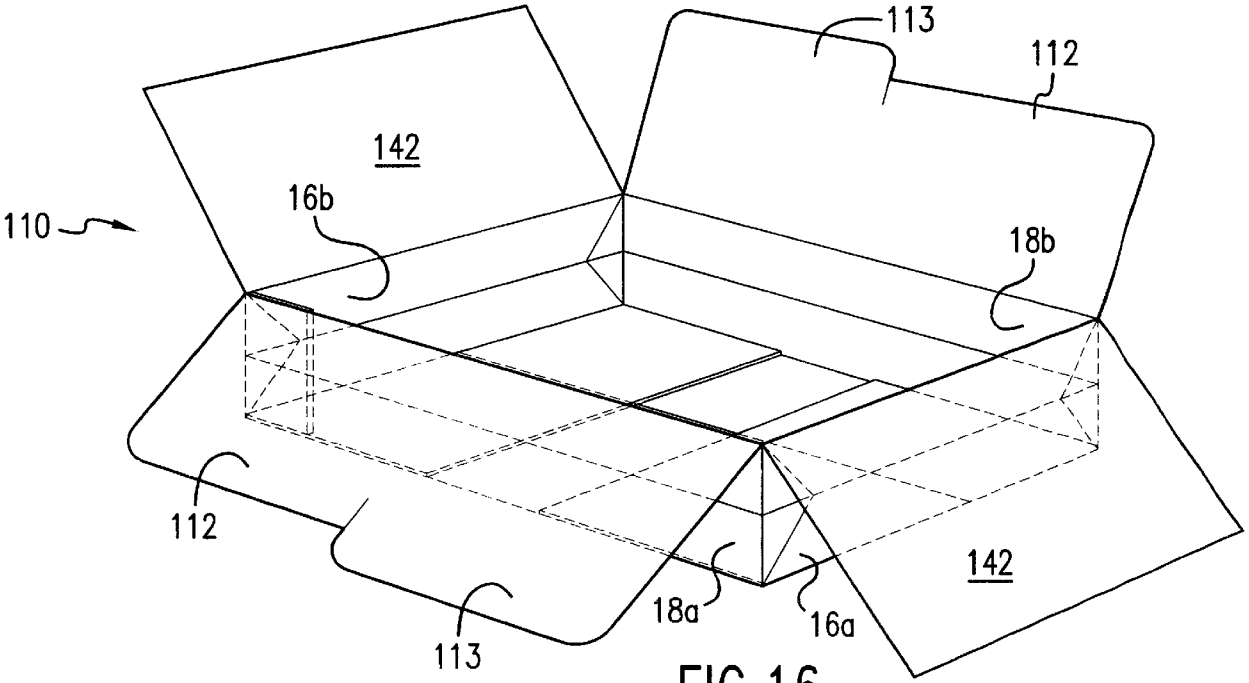
FIG. 16 is a front perspective view of another embodiment adjustable container of the present invention in an open state.
Figure 17:
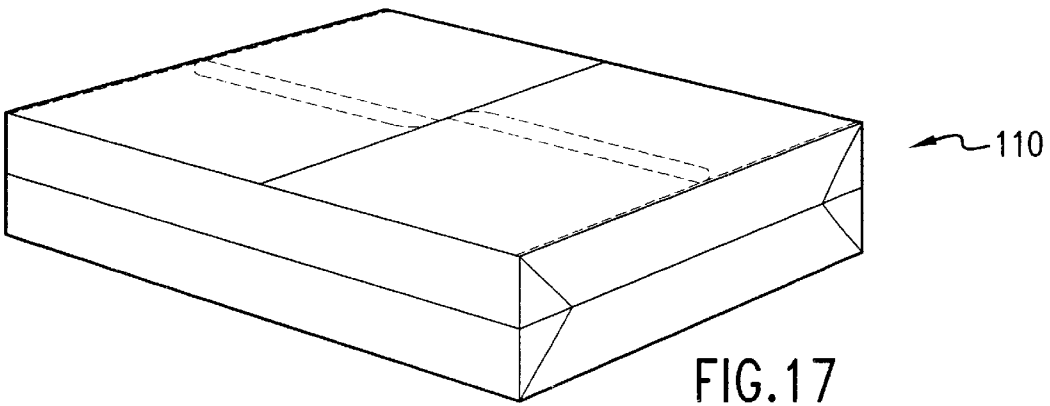
FIG. 17 is a front perspective view of the embodiment adjustable container illustrated in FIG. 16 in a closed state.

FIGS. 16 and 17 illustrate an alternative embodiment of a container 110 according to the present invention. Container 110 includes an interlocking top panel flap 112 extending from each of the second side panels 18*a*, 18*b*. Each top panel flap 112 includes an extension tab 113. When the top panel flaps 112 are folded to define the top panel of container 110, each extension tab 113 is overlaid on the opposite top panel flap 112. Alternatively, extension tab 113 is underlaid with respect to the opposite top panel flap 112. Additionally, the container 110 includes a top panel flap 142 extending from each of the first side panels 16*a*, 16*b*. The length of each top panel flap 142 is preferably half of the length of the second side panels 18*a*, 18*b* so than when the top panel flaps 142 are folded to further define the top panel of the container 110, the edges of the top panel flaps 142 abut as shown in FIG. 17. Container 110 with top panel flaps 142 and interlocking top panel flaps 112 provide a more rigid top panel than the previously described embodiments.

Figure 18:
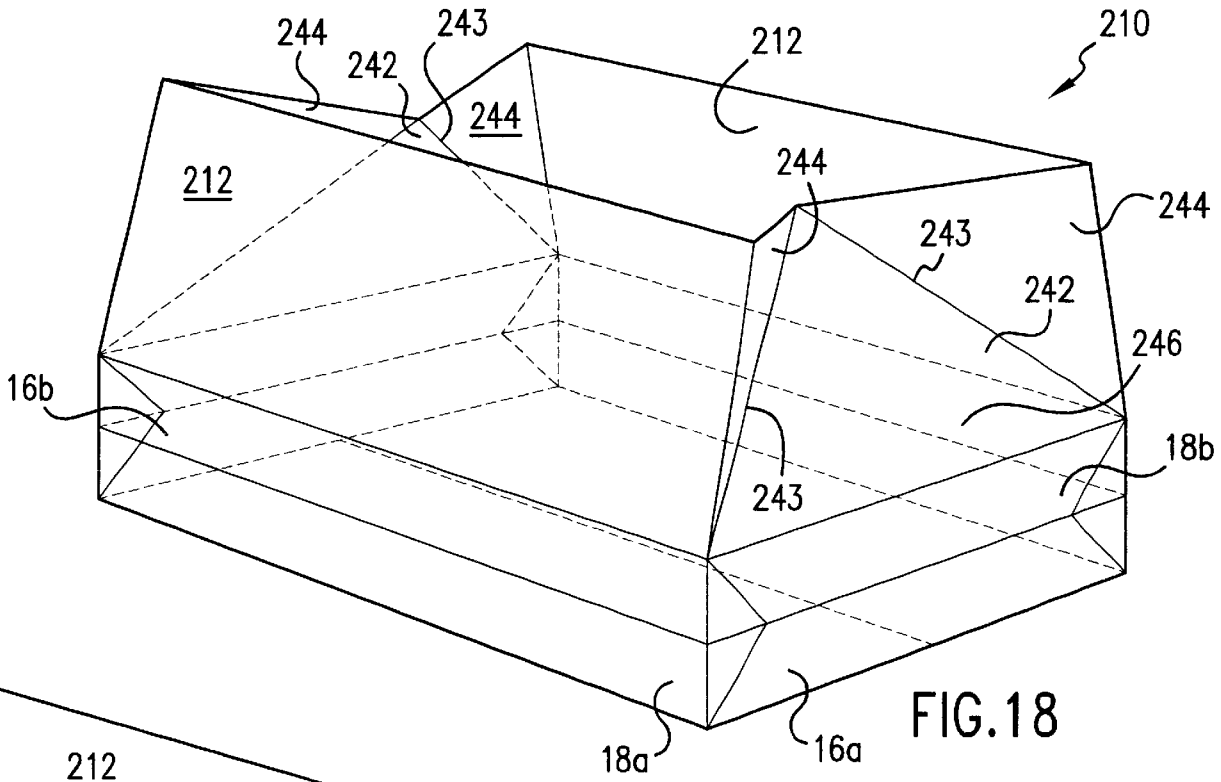
FIG. 18 is a front perspective view of still another embodiment adjustable container of the present invention in an open state.
Figure 19:
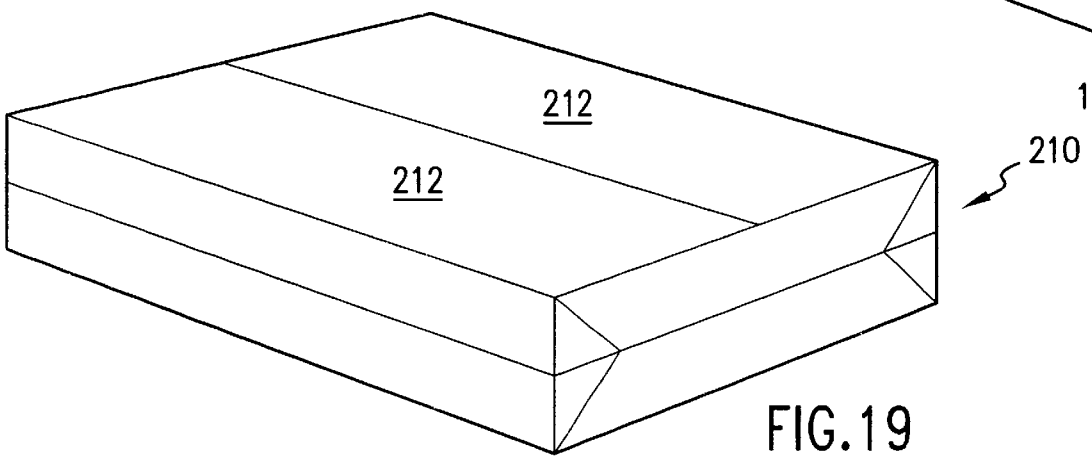
FIG. 19 is a front perspective view of the embodiment adjustable container illustrated in FIG. 18 in a closed state.

FIGS. 18 and 19 illustrate another alternative embodiment of a container 210 according to the present invention. Container 210 includes a top panel flap 212 extending from each second side panel 18*a*, 18*b*. Top panel flaps 212 are preferably rectangular having a width equal to the length of the second side panels 18*a*, 18*b* and a length equal to half the length of first side panels 16*a*, 16*b*. Container 210 further includes a top panel flap 242 extending from each first side panel 16*a*, 16*b*. Each top panel flap 242 is folded along folds lines 243 extending from opposite corners of top panel flap 242 to the top edge thereof. The fold lines 243 thereby define a central triangular section 246 and opposite triangular sections 244. Each opposite triangular section 244 is hingedly attached to an adjacent top panel flap 212. When top panel flaps 212 are folded inwardly, top panel flaps 242 are folded along the fold lines 243, thereby folding opposite triangular sections 242 over central triangular section 246. When completely folded inwardly, the top edges of top panel flaps 212 abut to define the top panel of container 210 as illustrated in FIG. 19.

Figure 20:
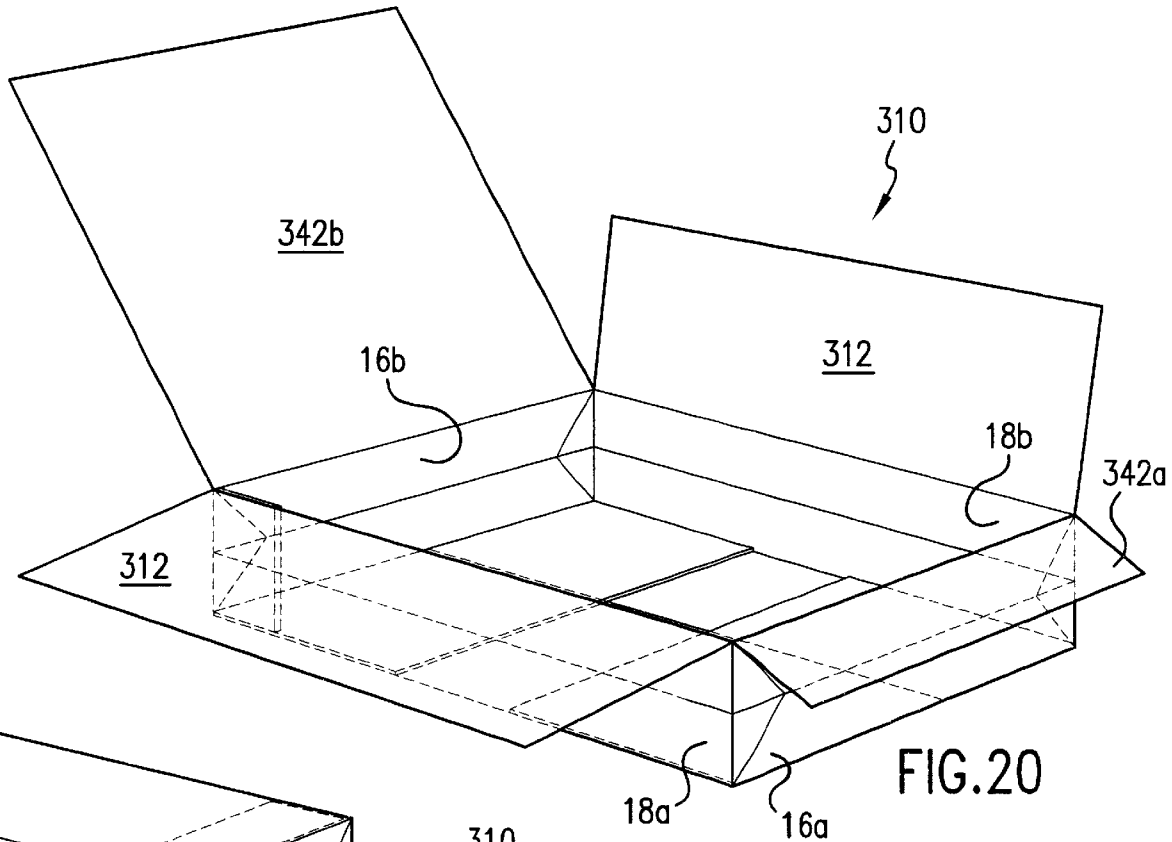
FIG. 20 is a front perspective view of yet another embodiment adjustable container of the present invention in an open state.
Figure 21:
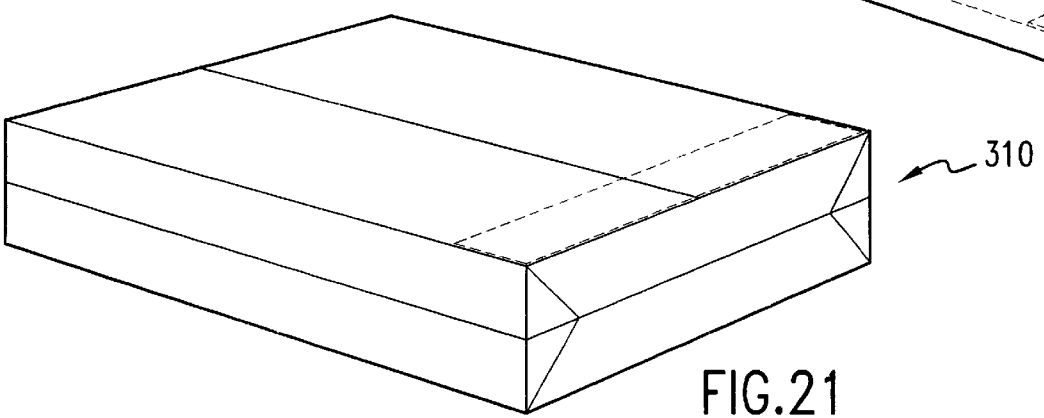
FIG. 21 is a front perspective view of the embodiment adjustable container illustrated in FIG. 20 in a closed state.

Finally, FIGS. 20 and 21 illustrate still another alternative embodiment of a container 310 according to the present invention. Container 310 includes a top panel flap 312 extending from each second side panel 18*a*, 18*b*. Top panel flaps 312 are preferably rectangular having a width equal to the length of the second side panels 18*a*, 18*b* and a length equal to half the length of first side panels 16*a*, 16*b*. Container 310 further includes top panel flap 342*a* extending from first side panel 16*a* and top panel flap 342*b* extending from first side panel 16*b*. As illustrated in FIG. 20, top panel flap 342*b* is substantially longer than top panel flap 342*a*. Preferably, the dimensions of top panel flap 342*b* correspond to the dimensions of the top panel. Preferably, top panel flap 342*b* is folded over top panel flap 342*a*, and top panel flaps 312 are then folded over top panel flaps 342*a*, 342*b* as shown in FIG. 21.

Thus, the several aforementioned objects and advantages of the present invention are most effectively attained. Those skilled in the art will appreciate that many modifications of the preferred embodiments described herein may be made without departing from the spirit and scope of the invention. Although the preferred embodiments of the invention have been disclosed and described in detail herein, it should be understood that this invention is in no sense limited thereby and its scope is to be determined by that of the appended claims.

What is claimed is:

1. An adjustable container, comprising:

a top panel having two first opposing side edges and two second opposing side edges;

a bottom panel having two first opposing side edges and two second opposing side edges;

two first side panels, each of the first side panels having a top edge hingedly connected to one of the two first opposing side edges of the top panel and a bottom edge hingedly connected to a respective one of the two first opposing side edges of the bottom panel, each first side panel having opposing side edges; and two second side panels, each of the second side panels having a top edge hingedly connected to one of the two second opposing side edges of the top panel and a bottom edge hingedly connected to a respective one of the two second opposing side edges of the bottom panel, each second side panel having opposing side edges, each side edge of the second side panels being hingedly connected to an adjacent side edge of an adjacent first side panel;

wherein each of the first side panels and the second side panels is scored along at least one longitudinal score line arranged substantially parallel to the top panel and to the bottom panel, and wherein each of the first side panels is scored along oblique score lines, each of the oblique score lines extending obliquely from a corner of the first side panel to one of the at least one longitudinal score lines, an interior volume of said container being adjustable by folding each of the first side panels and the second side panels inwardly toward the interior of the container along the at least one longitudinal score line and along the oblique score lines; and wherein each of the first side panels and the second side panels is scored along a plurality of longitudinal score lines.

2. The adjustable container according to claim 1, wherein each of the first side panels is scored along third score lines, each third score line extending substantially perpendicularly to the longitudinal score lines between an intersection point of one of the oblique score lines and one of the longitudinal score lines and an intersection point of another one of the oblique score lines and another one of the longitudinal score lines.

3. An adjustable container, comprising:

a top panel having two first opposing side edges and two second opposing side edges;

a bottom panel having two first opposing side edges and two second opposing side edges;

two first side panels, each of the first side panels having a top edge hingedly connected to one of the two first opposing side edges of the top panel and a bottom edge hingedly connected to a respective one of the two first opposing side edges of the bottom panel, each first side panel having opposing side edges; and two second side panels, each of the second side panels having a top edge hingedly connected to one of the two second opposing side edges of the top panel and a bottom edge hingedly connected to a respective one of the two second opposing side edges of the bottom panel, each second side panel having opposing side edges, each side edge of the second side panels being hingedly connected to an adjacent side edge of an adjacent first side panel;

wherein each of the first side panels and the second side panels is scored along at least one longitudinal score line arranged substantially parallel to the top panel and to the bottom panel, and wherein each of the first side panels is scored along oblique score lines, each of the oblique score lines extending obliquely from a corner of the first side panel to one of the at least one longitudinal score lines, an interior volume of said container being adjustable by folding each of the first side panels and the second side panels inwardly toward the interior of the container along the at least one longitudinal score line and along the oblique score lines; and wherein at least the first side panels and the second side panels are formed of a folded single sheet.

4. The adjustable container according to claim 3, wherein each of the first side panels and the second side panels is scored along a single longitudinal score line.

5. The adjustable container according to claim 4, wherein at least two of the oblique score lines intersect the single longitudinal score line on at least one common intersection point.

6. The adjustable container according to claim 3, wherein the top panel and the bottom panel are formed of the folded single sheet.

7. The adjustable container according to claim 3, wherein opposing edges of the single sheet are joined along a seam disposed at adjacent side edges of one of the first side panels and one of the second side panels.

8. The adjustable container according to claim 3, wherein opposing edges of the single sheet are joined along a seam disposed along one of the first side panels and the second side panels.

9. The adjustable container according to claim 8, wherein each of the opposing side edges of the single sheet is notched.

10. The adjustable container according to claim 3, wherein the sheet is formed of a foldable material.

11. The adjustable container according to claim 3, wherein the top edge of at least one of the first side panels is adhesively connected to the top panel.

12. The adjustable container according to claim 3, wherein the top edge of at least one of the second side panels is adhesively connected to the top panel.

13. The adjustable container according to claim 3, wherein at least one of the first side panels comprises a first abutting flap extending from the top panel and a second abutting flap extending from the bottom panel.

14. The adjustable container according to claim 3, wherein at least one of the second side panels comprises a first abutting flap extending from the top panel and a second abutting flap extending from the bottom panel.

15. The adjustable container according to claim 3, wherein at least a height of the interior volume of the container is adjustable.

16. The adjustable container according to claim 3, where at least a length and a width of the interior volume of the container is adjustable.

17. An adjustable container, comprising:

a top panel having two first opposing side edges and two second opposing side edges;

a bottom panel having two first opposing side edges and two second opposing side edges;

two first side panels, each of the first side panels having a top edge hingedly connected to one of the two first opposing side edges of the top panel and a bottom edge hingedly connected to a respective one of the two first opposing side edges of the bottom panel, each first side panel having opposing side edges; and two second side panels, each of the second side panels having a top edge hingedly connected to one of the two second opposing side edges of the top panel and a bottom edge hingedly connected to a respective one of the two second opposing side edges of the bottom panel, each second side panel having opposing side edges, each side edge of the second side panels being hingedly connected to an adjacent side edge of an adjacent first side panel;

wherein each of the first side panels and the second side panels is scored along at least one longitudinal score line arranged substantially parallel to the top panel and to the bottom panel, and wherein each of the first side panels is scored along oblique score lines, each of the oblique score lines extending obliquely from a corner of the first side panel to one of the at least one longitudinal score lines, an interior volume of said container being adjustable by folding each of the first side panels and the second side panels inwardly toward the interior of the container along the at least one longitudinal score line and along the oblique score lines; and wherein the top panel includes at least two abutting flaps, each of the two abutting flaps extending from the top edge of one of the first side panels and the second side panels.

18. An adjustable container, comprising:

a top panel having two first opposing side edges and two second opposing side edges;

a bottom panel having two first opposing side edges and two second opposing side edges;

two first side panels, each of the first side panels having a top edge hingedly connected to one of the two first opposing side edges of the top panel and a bottom edge hingedly connected to a respective one of the two first opposing side edges of the bottom panel, each first side panel having opposing side edges; and two second side panels, each of the second side panels having a top edge hingedly connected to one of the two second opposing side edges of the top panel and a bottom edge hingedly connected to a respective one of the two second opposing side edges of the bottom panel, each second side panel having opposing side edges, each side edge of the second side panels being hingedly connected to an adjacent side edge of an adjacent first side panel;

wherein each of the first side panels and the second side panels is scored along at least one longitudinal score line arranged substantially parallel to the top panel and to the bottom panel, and wherein each of the first side panels is scored along oblique score lines, each of the oblique score lines extending obliquely from a corner of the first side panel to one of the at least one longitudinal score lines, an interior volume of said container being adjustable by folding each of the first side panels and the second side panels inwardly toward the interior of the container along the at least one longitudinal score line and along the oblique score lines; and wherein the bottom panel includes at least two abutting flaps, each of the two abutting flaps extending from the bottom edge of one of the first side panels and the second side panels.

19. An adjustable container, comprising:

a top panel having two first opposing side edges and two second opposing side edges;

a bottom panel having two first opposing side edges and two second opposing side edges;

two first side panels, each of the first side panels having a top edge hingedly connected to one of the two first opposing side edges of the top panel and a bottom edge hingedly connected to a respective one of the two first opposing side edges of the bottom panel, each first side panel having opposing side edges; and two second side panels, each of the second side panels having a top edge hingedly connected to one of the two second opposing side edges of the top panel and a bottom edge hingedly connected to a respective one of the two second opposing side edges of the bottom panel, each second side panel having opposing side edges, each side edge of the second side panels being hingedly connected to an adjacent side edge of an adjacent first side panel;

wherein each of the first side panels and the second side panels is scored along at least one longitudinal score line arranged substantially parallel to the top panel and to the bottom panel, and wherein each of the first side panels is scored along oblique score lines, each of the oblique score lines extending obliquely from a corner of the first side panel to one of the at least one longitudinal score lines, an interior volume of said container being adjustable by folding each of the first side panels and the second side panels inwardly toward the interior of the container along the at least one longitudinal score line and along the oblique score lines; and further comprising one of a tape and a strap for maintaining the adjusted height of the container.

20. An adjustable container, comprising:

a top panel having two first opposing side edges and two second opposing side edges;

a bottom panel having two first opposing side edges and two second opposing side edges;

two first side panels, each of the first side panels having a top edge hingedly connected to one of the two first opposing side edges of the top panel and a bottom edge hingedly connected to a respective one of the two first opposing side edges of the bottom panel, each first side panel having opposing side edges; and two second side panels, each of the second side panels having a top edge hingedly connected to one of the two second opposing side edges of the top panel and a bottom edge hingedly connected to a respective one of the two second opposing side edges of the bottom panel, each second side panel having opposing side edges, each side edge of the second side panels being hingedly connected to an adjacent side edge of an adjacent first side panel;

wherein each of the first side panels and the second side panels is scored along at least one longitudinal score line arranged substantially parallel to the top panel and to the bottom panel, and wherein each of the first side panels is scored along oblique score lines, each of the oblique score lines extending obliquely from a corner of the first side panel to one of the at least one longitudinal score lines, an interior volume of said container being adjustable by folding each of the first side panels and the second side panels inwardly toward the interior of the container along the at least one longitudinal score line and along the oblique score lines; and wherein the top panel includes at least two top panel flaps, a first one of the top panel flaps at least partially overlapping and interlocking a second one of the top panel flaps.

21. An adjustable container, comprising:

a top panel having two first opposing side edges and two second opposing side edges;

a bottom panel having two first opposing side edges and two second opposing side edges;

two first side panels, each of the first side panels having a top edge hingedly connected to one of the two first opposing side edges of the top panel and a bottom edge hingedly connected to a respective one of the two first opposing side edges of the bottom panel, each first side panel having opposing side edges; and two second side panels, each of the second side panels having a top edge hingedly connected to one of the two second opposing side edges of the top panel and a bottom edge hingedly connected to a respective one of the two second opposing side edges of the bottom panel, each second side panel having opposing side edges, each side edge of the second side panels being hingedly connected to an adjacent side edge of an adjacent first side panel;

wherein each of the first side panels and the second side panels is scored along at least one longitudinal score line arranged substantially parallel to the top panel and to the bottom panel, and wherein each of the first side panels is scored along oblique score lines, each of the oblique score lines extending obliquely from a corner of the first side panel to one of the at least one longitudinal score lines, an interior volume of said container being adjustable by folding each of the first side panels and the second side panels inwardly toward the interior of the container along the at least one longitudinal score line and along the oblique score lines; and wherein the top panel includes two opposing first top panel flaps, each extending from a respective one of the second side panels, and two opposing second top panel flaps, each extending from a respective one of the first side panels, adjacent edges of the first top panel flaps and of the second top panel flaps being hingedly connected, at least one of the two first top panel flaps and the two second top panel flaps being folded along fold lines to define overlapping triangular sections when the first top panel flaps and second top panel flaps are folded to define the top panel.

22. An adjustable container, comprising:

a top panel having two first opposing side edges and two second opposing side edges;

a bottom panel having two first opposing side edges and two second opposing side edges;

two first side panels, each of the first side panels having a top edge hingedly connected to one of the two first opposing side edges of the top panel and a bottom edge hingedly connected to a respective one of the two first opposing side edges of the bottom panel, each first side panel having opposing side edges; and two second side panels, each of the second side panels having a top edge hingedly connected to one of the two second opposing side edges of the top panel and a bottom edge hingedly connected to a respective one of the two second opposing side edges of the bottom panel, each second side panel having opposing side edges, each side edge of the second side panels being hingedly connected to an adjacent side edge of an adjacent first side panel;

wherein each of the first side panels and the second side panels is scored along at least one longitudinal score line arranged substantially parallel to the top panel and to the bottom panel, and wherein each of the first side panels is scored along oblique score lines, each of the oblique score lines extending obliquely from a corner of the first side panel to one of the at least one longitudinal score lines, an interior volume of said container being adjustable by folding each of the first side panels and the second side panels inwardly toward the interior of the container along the at least one longitudinal score line and along the oblique score lines; and wherein the top panel includes a first top panel flap and a second top panel flap, wherein the first top panel flap overlaps the second top panel flap to define the top panel and wherein the dimensions of the first top panel flap are substantially equal to the dimensions of the top opening of the container.

* * * * *